US008270654B2

(12) United States Patent
Singh

(10) Patent No.: US 8,270,654 B2
(45) Date of Patent: Sep. 18, 2012

(54) CUSTOMIZABLE AUDIO EARPIECE

(76) Inventor: Sanjeev Kumar Singh, Danbury, CT (US)

( * ) Notice: Subject to any disclaimer, the term of this patent is extended or adjusted under 35 U.S.C. 154(b) by 476 days.

(21) Appl. No.: 12/576,708

(22) Filed: Oct. 9, 2009

(65) Prior Publication Data

US 2010/0220885 A1 Sep. 2, 2010

Related U.S. Application Data

(60) Provisional application No. 61/156,702, filed on Mar. 2, 2009.

(51) Int. Cl.
*H04R 25/00* (2006.01)

(52) U.S. Cl. ..... 381/379; 381/374; 381/370

(58) Field of Classification Search ..... 381/328, 381/370, 371, 374, 376, 379, 380; 379/430; 455/575.2

See application file for complete search history.

(56) References Cited

U.S. PATENT DOCUMENTS

2010/0284559 A1* 11/2010 Scholz et al. ..... 381/374

* cited by examiner

*Primary Examiner* — Tuan Nguyen

(74) *Attorney, Agent, or Firm* — Sanjeev K. Singh

(57) ABSTRACT

A customizable audio earpiece includes an ear bud body with an ear bud size of which is adjustable along with some control over its orientation. The ear bud body comprises a ball point with teeth that couples to a mating cavity with teethed groves to movably lock or snap with each other on an ear bud stick. The flexibility of one or more petal shaped fingers provides an adequate level of stiffness for the ear bud when resting therein. The teeth on the ends of these petal shaped fingers releasably couple to teeth on a speaker body. In this way, users have varying size of ears with different size of ear canal cavities and conchal bowls can comfortably use the customizable audio earpiece.

20 Claims, 4 Drawing Sheets

CUSTOMIZABLE AUDIO EARPIECE

CROSS REFERENCE TO RELATED APPLICATIONS

This application claims priority under 35 U.S.C. 119(e) to U.S. provisional application Ser. No. 61/156,702, filed Mar. 2, 2009, which is expressly incorporated by reference herein in its entirety into this application.

BACKGROUND OF THE INVENTION

1. Field of the Invention

This invention relates generally to an electronic earpiece device and more particularly, to a customizable audio earpiece.

2. Description of the Related Art

Use of audio earpieces that include an ear bud which is configured to be received in the ear of a user of a personal electronic device is well known. While many of such audio earpieces adequately produce sound from playing prerecorded audio content, they come with a standard size ear buds. The ear canal cavity of the ear supports such standard size ear bud during their usage. In particular, a typical ear bud has a fixed stick-shaped support to orient the ear bud within the conchal bowl of the ear.

However, users have varying size of ears with different size of ear canal cavities and conchal bowls. In other words, since no two ears are created equal, the approach of one size fits all is somewhat not ideal. This approach makes the experience of extended listening to a favorite music or audio content sometimes a bit painful and tiring. Likewise, using Bluetooth headsets with cell phones can be cumbersome experience. This is a particular problem where the users either have smaller than normal size ears or have slightly bigger ears with oddly shaped conchal bowls.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present invention is directed to overcoming, or at least reducing, the effects of, one or more of the problems set forth above.

In one embodiment of the present invention, a customizable audio earpiece for use with a personal electronic device to fit in a first ear of a user having a first ear canal cavity is provided. The customizable audio earpiece may comprise a first ear bud body including a first speaker and configured to be supported by the first ear. The first ear bud body may include a first ear bud having a face, a major end and a minor end, a first ear bud support coupled to the minor end of the first ear bud and a plurality of first generally flexible fingers coupled to the first ear bud at the minor end and extending over the first speaker towards the major end of the first ear bud for supporting the first ear bud by the first ear canal cavity.

In another embodiment of the present invention, a customizable audio earpiece for use with a personal electronic device to fit in a first ear of a user having a first ear canal cavity is provided. The customizable audio earpiece may comprise a first ear bud body including a first speaker and configured to be supported by the first ear. The first ear bud body may include a first ear bud having a face, a major end and a minor end and a first ear bud support coupled to the minor end of the first ear bud, wherein the first ear bud further comprising a first component at the minor end, and the first ear bud support including a second component to movably receive the first component such that the first ear bud is adjustable relative to the first ear bud support to at least two positions.

In yet other embodiment of the present invention, a customizable audio earpiece for use with a personal electronic device to fit in an ear of a user having an ear canal cavity is provided. The customizable audio earpiece may comprise an ear bud body including a speaker and configured to be supported by the ear. The ear bud body may include an ear bud having a front face, a side face, a major end and a minor end, an ear bud support coupled to the minor end of the ear bud and a plurality of generally flexible fingers coupled to the ear bud and extending over the speaker for supporting the ear bud by the ear canal cavity.

BRIEF DESCRIPTION OF THE DRAWINGS

The invention may be understood by reference to the following description taken in conjunction with the accompanying drawings, in which like reference numerals identify like elements, and in which.

Figure 1A:
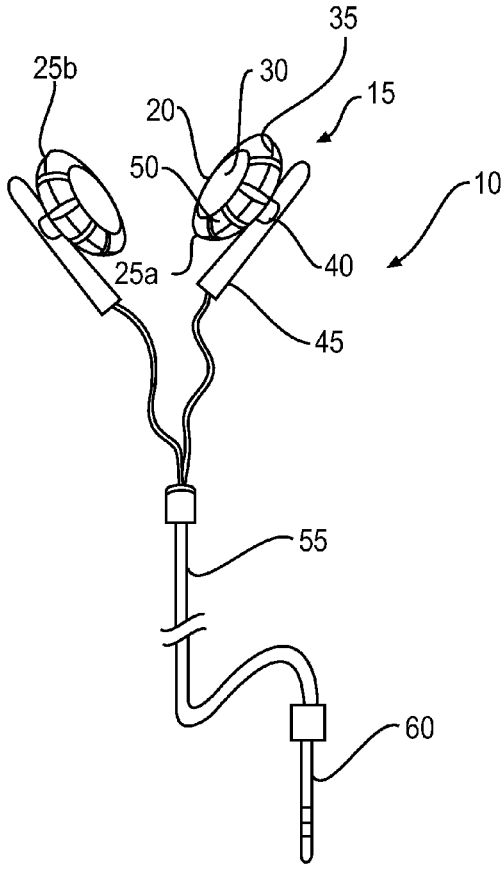
FIG. 1A schematically illustrates a customizable audio earpiece in accordance with one embodiment of the present invention.

While the invention is susceptible to various modifications and alternative fowls, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Generally, a customizable audio earpiece includes an ear bud body with an ear bud size of which is adjustable along with some control over its orientation. The ear bud body comprises a ball point with teeth that couples to a mating cavity with teethed groves to movably lock or snap with each other on an ear bud stick. The flexibility of one or more petal shaped fingers provides an adequate level of stiffness for the ear bud when resting therein. The teeth on the ends of these petal shaped fingers releasably couple to teeth on a speaker body. In this way, users have varying size of ears with different size of ear canal cavities and conchal bowls can comfortably use the customizable audio earpiece. Since no two ears are created equal, the approach of one size fits all is avoided. This approach makes the experience of extended listening to a favorite music or audio content sometimes pleasant and not tiring. Likewise, using Bluetooth headsets with cell phones can be good experience. This customizable audio earpiece is a particularly useful where the users either have smaller than normal size ears or have slightly bigger ears with oddly shaped conchal bowls.

Referring to FIG. 1A, a customizable audio earpiece 10 for use with a personal electronic device is provided according to one embodiment of the present invention. The customizable audio earpiece 10 is intended to be widely used in conjunction with a variety of personal electronic devices according to some embodiments of the present invention. Examples of a personal electronic device include, but not limited to, a digital music player, a cell phone, a personal digital assistant, an Internet device, a gaming device, a computing device, a wireless device, a video device, a radio device, an audio device and an audio-video device.

Although embodiments of present invention have been described as an audio earpiece for use in the consumer electronics area, it may also be used independently for other applications such as hearing aid earpiece.

The customizable audio earpiece 10 is ergonomically designed to fit in an ear of a user having an ear canal cavity. That is, it is modifiable to conform to individual ear canals or conchal bowls. The customizable audio earpiece 10 permits a user to easily grasp it for introduction into and removable from a user's ear canal. The shape, size, or volume of the customizable audio earpiece 10 is formed so that its insertion will not clog the ear canal.

In accordance with one embodiment of the present invention, the customizable audio earpiece 10 comprises an ear bud body 15 including a speaker 20 and configured to be supported by the ear. The ear bud body 15 includes a first ear bud 25*a* (e.g., similarly a second ear bud 25*b*) having a face 30, a major end 35 and a minor end 40 and an ear bud support 45 coupled to the minor end 40 of the ear bud 25*a*. The ear bud body 15 further includes a plurality of generally flexible fingers 50 coupled to the first ear bud 25*a* at the minor end 40 and extending over the speaker 20 towards the major end 35 of the first ear bud 25*a* for supporting the first ear bud 25*a* by the ear canal cavity. In one embodiment, the plurality of generally flexible fingers 50 cover a portion of the face 30 of the first ear bud 25*a*. In one embodiment, the plurality of first generally fingers 50 coupled to the face of the first ear bud 25*a*.

It should be noted that, although the embodiment shown in FIG. 1A is described using the ear canal cavity, the first ear bud 25*a* may be supported by either the ear canal or the conchal bowl of the ear, at the user's option or positioning or orientation thereof.

According to one embodiment of the present invention, the first ear bud 25*a* encloses the speaker 20 in a well known ways of the prior art. The ergonomic shape of the first ear bud 25*a* allows it to be placed comfortably in the ear of a user. Any additional circuitry in the first ear bud 25*a* is not significant aspect of the present invention.

The customizable audio earpiece 10 also comprise a second ear bud similar to the first ear bud 25*a* for use with the other ear of the user for listening music in a stereo mode. The customizable audio earpiece 10, as shown in FIG. 1A, further comprises an audio cable 55 for electrically connecting the ear bud body 15 to the personal electronic device via a connector 60.

In one embodiment, the ear body 15 may be intended to be a non-occluding type, such that the ear canal cavity is not obstructed thereby. This ability enhances the safety and convenience since user's hearing is not significantly impaired. Other embodiments may be useful and equally applicable if used with an occluding type ear bud.

Figure 1B:
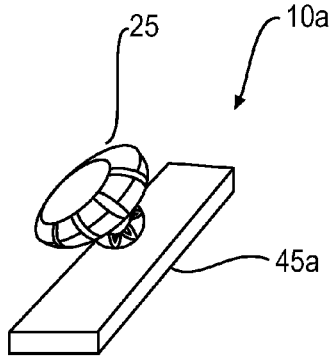
FIG. 1B schematically illustrates a customizable audio earpiece in accordance with another embodiment of the present invention.

Referring to FIG. 1B, it schematically illustrates another customizable audio earpiece 10*a* in accordance with another embodiment of the present invention. Examples of the another customizable audio earpiece 10*a* includes a Bluetooth headset for use with a cell phone. The another customizable audio earpiece 10*a* may comprise an ear bud 25 and an ear bud support 45*a*, which may include a microphone.

In one embodiment, the customizable audio earpiece 10 may be a headset that contains small speakers to be placed on or near one or both ears of the user for allowing the user to hear audio signals produced by a personal electronic device. For example, the first ear bud 25*a* may be placed in or near the ear canal of the user for producing sound to be heard by the user.

Figure 2:
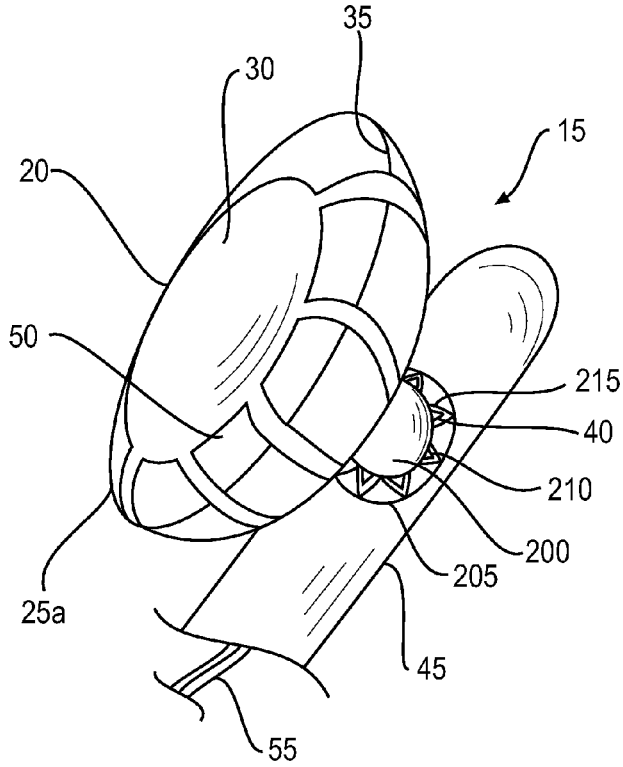
FIG. 2 schematically illustrates an ear bud of the customizable audio earpiece shown in FIG. 1A in accordance with one embodiment of the present invention.

Referring to FIG. 2, it schematically illustrates some details of the first ear bud 25*a* of the customizable audio earpiece 10 shown in FIG. 1A in accordance with one embodiment of the present invention. In the customizable audio earpiece 10, the first ear bud 25*a* further comprises a first component such as a ball point head 200 at the minor end 40. The ear bud support 45 may include a second component such as a first mating cavity 205 to movably receive the ball point head 200 such that the first ear bud 25*a* is adjustable relative to the ear bud support 45 to at least two positions. The ball point head 200 may include a plurality of teeth 210 and the first mating cavity 205 including a plurality of corresponding grooves 215 to movably receive the plurality of teeth 210. In this way, mating of the ball point head 200 and the first mating cavity 205 provides a pivot point for selectively moving the first ear bud 25*a* relative to the ear bud support 45.

The combination of the ball point head 200 and the first mating cavity 205 may allow substantial rotational and angular displacement freedom of relative movement between the first ear bud 25*a* and the ear bud support 45.

Figure 3:
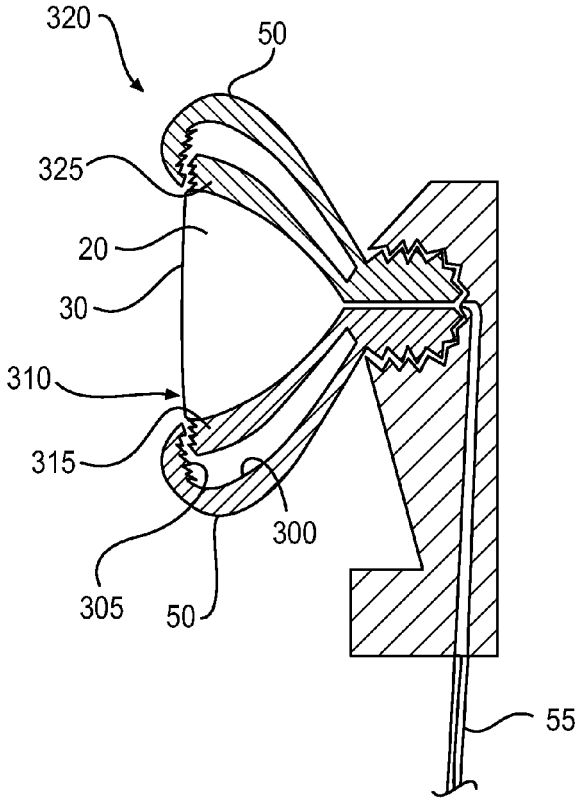
FIG. 3 schematically illustrates a crossectional view of the ear bud of the customizable audio earpiece shown in FIG. 2 in accordance with one embodiment of the present invention.

Referring to FIG. 3, it schematically illustrates a crossectional view of the first ear bud 25*a* of the customizable audio earpiece 10 shown in FIG. 2 in accordance with one embodiment of the present invention. The plurality of generally flexible fingers 50 each may have an inner surface 300 with engaging teeth 305. The face 30 of the first ear bud 25*a* may have an edge surface 310 with receiving teeth 315 to snugly receive the engaging teeth 305 of the plurality of generally flexible fingers 50. The degree with which the engaging teeth 305 couple with the receiving teeth 315 defines size, volume or shape of the first ear bud 25*a* when resting in the ear canal cavity of the user.

In accordance with one embodiment of the present invention, the plurality of generally flexible fingers 50 each may comprise a resilient claw 320 on a distal end to engagively grab onto the speaker 20 by using the engaging teeth 305. Each claw 320 may extend over an edge portion 325 of the face 30 of the first ear bud 25*a* to resiliently engage with the speaker 20 at the edge portion 325 of the face 30 of the first ear bud 25*a*.

In one embodiment, each claw 320 may be coupled to adjacent claws 320 at a distal end thereof. The plurality of generally flexible fingers 50 and each claw 320 may comprise either rubber or plastic, or both. In this way, mating of the engaging teeth 305 and receiving teeth 315 may provide an adjustable grip with variable flexibility when snapped or locked with each other. That is, exterior and interior teeth would correspond to a saw-type groove-ridge snap-fit connection that maintains a specific shape and bonding once properly latched.

Figure 4:
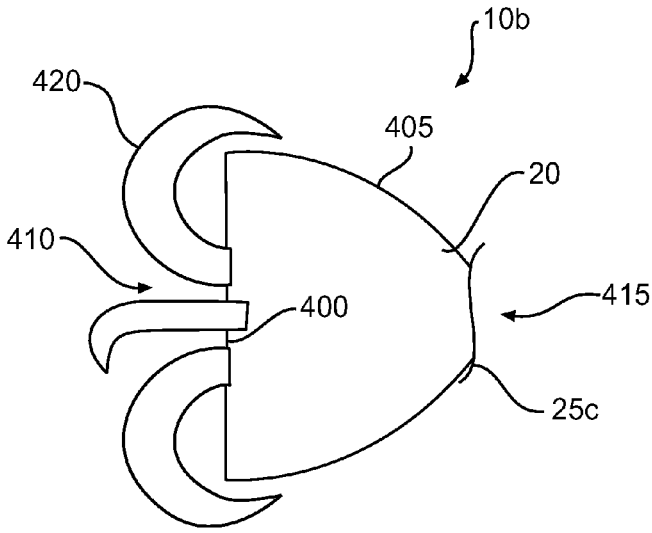
FIG. 4 schematically illustrates a customizable audio earpiece in accordance with one embodiment of the present invention.

Referring to FIG. 4, it schematically illustrates a yet another customizable audio earpiece 10*b* in accordance with one embodiment of the present invention. An ear bud body 15*a* may include an ear bud 25*c* having a front face, 400 a side face 405, a major end 410 and a minor end 415. The ear bud body 15*a* may further include an ear bud support coupled to the minor end 415 of the ear bud 25*c*. The ear bud body 15*a* may further include a first plurality of generally flexible fingers 420 coupled to the ear bud 25*c* and extending over the speaker 20 for supporting the ear bud 25*c* by the ear canal cavity. The first plurality of generally flexible fingers 420 may be coupled to the ear bud 25*c* at the front face 400 and extend over the speaker 20 towards the minor end 415 of the ear bud 25*c*.

In other words, the first plurality of generally flexible fingers 420 flexibly protrude away from the ear bud 25*c*, enabling them softly engage with the ear canal cavity. Such gentle grip of the first plurality of generally flexible finger 420 would secure the ear bud 25*c* comfortably based on a physical profile of the ear of a particular user. This ability may allow the first ear bud 25*a* of FIG. 1A to switch easily between small and big configurations by a gentle push by using a resilient material.

A specific size of the first ear bud 25*a* would engage different shape and size of the walls of the ear canal, for example, using resilient petals of a flower like structure. However, other shapes and constructions of custom fingers may be used depending upon a particular application.

The ear bud 25*c* may further comprise a ball point head at the minor end 415, and the ear bud support including a mating cavity to movably receive the ball point head such that the ear bud 25*c* is adjustable relative to the ear bud support to at least two positions.

Figure 5:
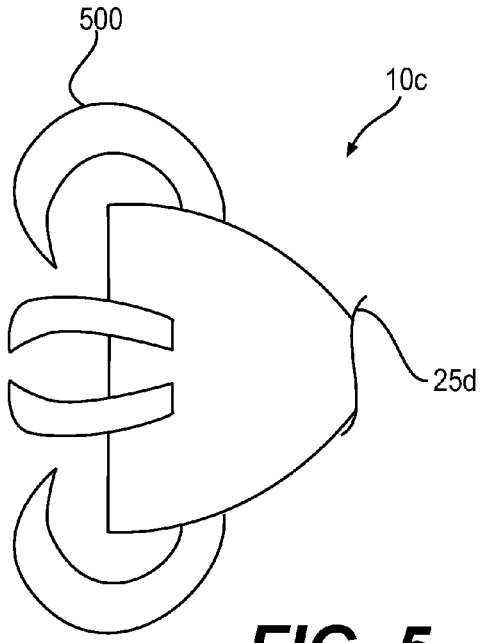
FIG. 5 schematically illustrates a customizable audio earpiece in accordance with one embodiment of the present invention.

Referring to FIG. 5, it schematically illustrates a yet another customizable audio earpiece 10*c* in accordance with one embodiment of the present invention. An ear bud body 15*b* may include an ear bud 25*d* having the front face, 400 the side face 405, the major end 410 and the minor end 415. The ear bud body 15*b* may further include an ear bud support coupled to the minor end 415 of the ear bud 25*d*. The ear bud body 15*b* may further include a second plurality of generally flexible fingers 500 coupled to the ear bud 25*d* at the side face 405 and extending over the speaker 20 towards the front face 400.

Portions of the present invention and corresponding detailed description are presented in terms of physical and symbolic representations of components. These descriptions and representations are the ones by which those of ordinary skill in the art effectively convey the substance of their work to others of ordinary skill in the art. It should be borne in mind, however, that all of these and similar components are to be associated with the appropriate physical quantities and are merely convenient labels applied to these structures.

The present invention set forth above is described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. A customizable audio earpiece for use with a personal electronic device to fit in a first ear of a user having a first ear canal cavity, the customizable audio earpiece comprising:

a first ear bud body including a first speaker and configured to be supported by the first ear, the first ear bud body including:

a first ear bud having a face, a major end and a minor end;

a first ear bud support coupled to the minor end of the first ear bud; and a plurality of first generally flexible fingers coupled to the first ear bud at the minor end and extending over the first speaker towards the major end of the first ear bud for supporting the first ear bud by the first ear canal cavity.

2. The customizable audio earpiece, as set forth in claim 1, wherein the plurality of first generally flexible fingers covering a portion of the face of the first ear bud.

3. The customizable audio earpiece, as set forth in claim 1, wherein the first ear bud further comprising a ball point head at the minor end, and the first ear bud support including a first mating cavity to movably receive the ball point head such that the first ear bud is adjustable relative to the first ear bud support to at least two positions.

4. The customizable audio earpiece, as set forth in claim 1, wherein the ball point head including a plurality of teeth and the first mating cavity including a plurality of corresponding grooves to movably receive the plurality of teeth.

5. The customizable audio earpiece, as set forth in claim 4, wherein mating of the ball point head and the first mating cavity provides a pivot point for selectively moving the first ear bud relative to the first ear bud support.

6. The customizable audio earpiece, as set forth in claim 1, wherein the plurality of first generally flexible fingers coupled to the face of the first ear bud.

7. The customizable audio earpiece, as set forth in claim 1, wherein the plurality of first generally flexible fingers each having an inner surface with engaging teeth.

8. The customizable audio earpiece, as set forth in claim 7, wherein the face of the first ear bud having an edge surface with receiving teeth to snugly receive the engaging teeth of the plurality of first generally flexible fingers.

9. The customizable audio earpiece, as set forth in claim 8, wherein the degree with which the engaging teeth couple with the receiving teeth defines size, volume or shape of the first ear bud when resting in the ear canal cavity of the user.

10. The customizable audio earpiece, as set forth in claim 1, wherein the plurality of first generally flexible fingers each comprising a resilient claw on a distal end to engagively grab onto the first speaker by using the engaging teeth.

11. The customizable audio earpiece, as set forth in claim 10, wherein each claw extends over an edge portion of the face of the first ear bud to resiliently engage with the first speaker at the edge portion of the face of the first ear bud.

12. The customizable audio earpiece, as set forth in claim 11, wherein each claw is coupled to adjacent claws at a distal end thereof, the plurality of first generally flexible fingers and each claw comprises at least one of rubber and plastic and mating of the engaging teeth and receiving teeth provides an adjustable grip with variable flexibility when snapped or locked with each other.

13. The customizable audio earpiece, as set forth in claim 1, further comprising:

a second ear bud body including a second speaker and configured to be supported by a second ear, the second ear bud body including:

a second ear bud having a face, a major end and a minor end;

a second ear bud support coupled to the minor end of the first ear bud; and a plurality of second generally flexible fingers coupled to the second ear bud at the minor end and extending over the second speaker towards the major end of the second ear bud for supporting the second ear bud by a second ear canal cavity.

14. A customizable audio earpiece for use with a personal electronic device to fit in a first ear of a user having a first ear canal cavity, the customizable audio earpiece comprising:

a first ear bud body including a first speaker and configured to be supported by the first ear, the first ear bud body including:

a first ear bud having a face, a major end and a minor end; and a first ear bud support coupled to the minor end of the first ear bud, wherein the first ear bud further comprising a first component at the minor end, and the first ear bud support including a second component to movably receive the first component such that the first ear bud is adjustable relative to the first ear bud support to at least two positions and a first support configuration that adapts the first ear bud in at least one of a shape, size and volume to define a variable form which custom fits in the first ear of the user by conforming to the first ear canal cavity, wherein the first support configuration provides the variable form relative to a second support configuration that adapts the first ear bud to make the first ear bud suitable to custom fit in a different ear of another user.

15. The customizable audio earpiece, as set forth in claim 14, wherein the first component is a ball point head and the second component is a first mating cavity and the ball point head including a plurality of teeth and the first mating cavity including a plurality of corresponding grooves to movably receive the plurality of teeth.

16. The customizable audio earpiece, as set forth in claim 15, wherein mating of the ball point head and the first mating cavity provides a pivot point for selectively moving the first ear bud relative to the first ear bud support.

17. A customizable audio earpiece for use with a personal electronic device to fit in an ear of a user having an ear canal cavity, the customizable audio earpiece comprising:

an ear bud body including a speaker and configured to be supported by the ear, the ear bud body including:

an ear bud having a front face, a side face, a major end and a minor end;

an ear bud support coupled to the minor end of the ear bud; and a first support configuration that adapts the ear bud in at least one of a shape, size and volume to define a variable form which custom fits in the ear of the user by conforming to the ear canal cavity, wherein the first support configuration provides the variable form relative to a second support configuration that adapts the ear bud to make the ear bud suitable to custom fit in a different ear of another user.

18. The customizable audio earpiece, as set forth in claim 17, wherein the first support configuration includes a plurality of generally flexible fingers coupled to the ear bud and extending over the speaker for supporting the ear bud by the ear canal cavity and the plurality of generally flexible fingers coupled to the ear bud at the front face and extending over the speaker towards the minor end of the ear bud.

19. The customizable audio earpiece, as set forth in claim 18, wherein the plurality of generally flexible fingers instead coupled to the ear bud at the side face and extending over the speaker towards the front face.

20. The customizable audio earpiece, as set forth in claim 17, wherein the ear bud further comprising a ball point head at the minor end, and the ear bud support including a mating cavity to movably receive the ball point head such that the ear bud is adjustable relative to the ear bud support to at least two positions.

* * * * *